United States Patent [19]

Gamble

[11] 3,935,377

[45] Jan. 27, 1976

[54] ELECTRICAL BUSHING COMPRISING A RESIN BODY AND A CERAMIC OUTER SHELL

[75] Inventor: James R. Gamble, Greensburg, Pa.

[73] Assignee: Westinghouse Electric Corporation, Pittsburgh, Pa.

[22] Filed: Dec. 24, 1974

[21] Appl. No.: 536,068

[52] U.S. Cl. ..... 174/153 R; 174/209

[51] Int. Cl.[2] ..... H01B 17/26; H01B 17/32

[58] Field of Search ..... 174/18, 31 R, 140 R, 142, 174/152 R, 153 R, 178, 209, 210; 339/94 A, 126 R, 126 RS, 129, 218 R

[56] References Cited

UNITED STATES PATENTS

| | | | |
|---|---|---|---|
| 1,284,975 | 11/1918 | Austin | 174/210 |
| 2,447,489 | 8/1948 | Clark | 174/153 R |
| 3,001,005 | 9/1961 | Sonnenberg | 174/209 X |
| 3,242,446 | 3/1966 | Leute | 174/152 R X |
| 3,433,893 | 3/1969 | Hofmann et al. | 174/153 R |
| 3,515,799 | 6/1970 | Ristuccia et al. | 174/153 R |
| 3,812,284 | 5/1974 | Pohl | 174/209 X |

FOREIGN PATENTS OR APPLICATIONS

| | | | |
|---|---|---|---|
| 26,778 | 1/1964 | Germany | 174/152 R |
| 846,750 | 6/1939 | France | 174/153 R |

*Primary Examiner*—Laramie E. Askin
*Attorney, Agent, or Firm*—L. P. Johns

[57] ABSTRACT

An electrical bushing characterized by a cup-shaped ceramic shell and a conductor extending longitudinally therethrough. A non-porous epoxy resin occupies the shell and adheres to the conductor. The conductor and the epoxy resin have corresponding coefficients of thermal expansion.

4 Claims, 1 Drawing Figure

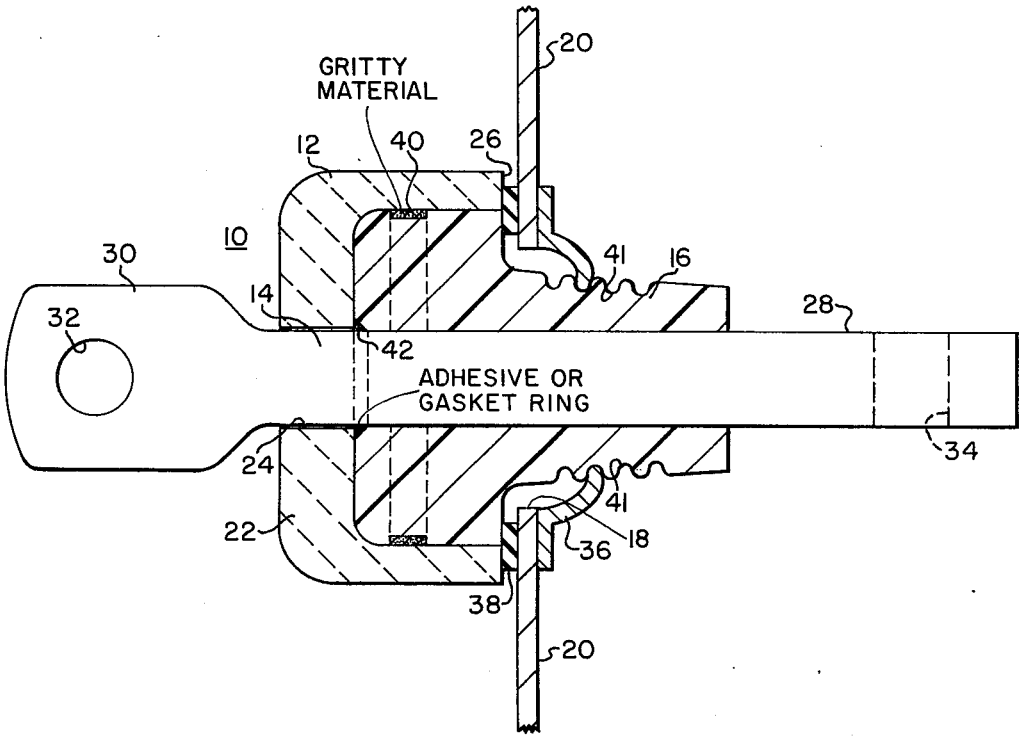
GRITTY
MATERIAL
20
12
40
26
10
30
41
16
14
28
32
42
ADHESIVE OR
GASKET RING
24
34
41
22
18
36
38
20

ELECTRICAL BUSHING COMPRISING A RESIN BODY AND A CERAMIC OUTER SHELL

BACKGROUND OF THE INVENTION

1. Field of the Invention:

This invention relates generally to insulating electrical devices, and, more particularly, to terminal bushings for transformers.

2. Description of the Prior Art:

Secondary bushings for use on outdoor transformers have customarily consisted of porcelain and a metal conductor which are locked together mechanically and sealed with gaskets. The sealing requirement has added considerably to the cost of the bushing. Various attempts have been made to achieve a more economical product without sacrificing a suitable operating bushing. For example, replacement of the porcelain member with an epoxy resin cast around the conductor proved unsatisfactory, because a required compromise in the resin composition to achieve a coefficient of expansion comparable to that of the conductor resulted in a reduction of the arc and track resistance. U.S. Pat. No. 3,433,893 generally discloses an electrical bushing of the type involved herein.

SUMMARY OF THE INVENTION

It has been found in accordance with this invention that the foregoing problem may be overcome by providing an electrical bushing comprising a cup-shaped ceramic shell having a central opening, a conductor extending longitudinally through the shell and the central opening, a non-porous epoxy resin occupying the shell and adhering to the conductor which resin has a coefficient of thermal expansion substantially corresponding to that of the conductor.

The advantage of the bushing of this invention is that it provides an electrical bushing having a ceramic outer surface with satisfactory arc and track resistance and having an interior resin component having a coefficient of thermal expansion comparable to that of the conductor, whereby a more durable bushing is provided.

DESCRIPTION OF THE DRAWINGS

For a better understanding of this invention reference is made to the single FIGURE of the drawing which is a vertical sectional view through an electrical bushing which is mounted on the tank of a distribution transformer.

DESCRIPTION OF THE PREFERRED EMBODIMENTS

In the drawing an electrical bushing is generally indicated at 10 and it comprises a shell 12, a conductor or stud 14, and a body 16 of resinous material. The bushing 10 is shown mounted in an opening 18 of a housing or tank 20 of a distribution transformer.

The shell 12 is preferably a cylindrical member including an end wall 22 having an aperture 24. The shell 12 also includes an end 26 opposite the end wall 22. The shell 12, being an insulator, is composed of a ceramic material, such as porcelain, to provide the desirable characteristics of arc and track resistance in a manner well known in the art.

The conductor 14 is an elongated metallic member preferably composed of a material of good electrical characteristics, such as copper or aluminum. Although the conductor 14 is predominately round and has a threaded inner end portion 28, the outer end 30 is flattened and preferably includes an aperture 32 for conveniently connecting thereto. The inner end portion 28 of the conductor is likewise flattened and provided with suitable fastening means, such as a hole 34. To improve the sealing joint between the end 26 of the shell and the outer surface of the tank, an annular gasket 38 is preferably provided. The inner end portion 28 of the conductor 14 is connected to a conductor (not shown) within the transformer which extends to a transformer coil in a conventional manner.

The body 16 is composed of an insulating material different from the porcelain of the shell 12. It is preferably composed of an epoxy resin, such as an anhydride cured bisphenol resin, that is filled with a graded particle sized fused silica. The resin formulation closely matches the coefficient of expansion of the conductor 14 and has very good room temperature and high temperature strength. The body 16 of resin is formed by casting the resin into the shell so that after the curing of the body 16, it is readily placeable in the opening 18 of the tank 20. The body 16 adheres tightly to the surface of the conductor 14. Although it adheres also to the inner surface of the shell 12, the latter is preferably provided with areas, such as an annular band 40, of a gritty material, such as sand, by which the body 16 is locked in place and prevents subsequent detachment or loosening of the body 16 from the shell 12, such as by twisting during installation. The outer surface of the body 16 may include threads 41 molded therein which cooperate with a spring grip nut 36 for clamping the bushing 10 tightly in place against the housing 20.

In accordance with this invention the porcelain shell 12 protects the exposed portion of the resinous body 16 and eliminates the requirement of that body for a high degree of arc and track resistance. However, the body 16 is readily formulated to provide the property of the coefficient of expansion comparable to that of the material of the conductor 14. That property is necessary because the body 16 of resin necessarily adheres tightly to the intermediate portion of the conductor.

As shown in the drawing, the aperture 24 of the shell 12 is slightly greater than the diameter of the conductor 14 to prevent their adherence such as by binding which may subsequently cause the porcelain shell 12 to rupture in response to extreme contractions or expansion of the metallic conductor 14. At the inner end of the opening 24 an adhesive or gasket ring 42 is provided and is composed of a silicone material.

What is claimed is:

1. An electrical bushing adaptable for insertion through an aperture in the casing of electrical apparatus comprising, a cup-shaped ceramic shell having a central opening, a conductor extending longitudinally through the shell and the central opening, the conductor having a smaller diameter than the central opening, a body of epoxy resin occupying the interior of the shell and adhering to the conductor and to the shell, the resinous body including a portion extending out of the side of the shell opposite the central opening and around the conductor, the combination of said portion and the conductor being insertable through the aperture and into the casing of electrical apparatus, the conductor and the epoxy resinous body have corresponding coefficients of expansion, and means on said portion for detachably mounting the bushing in place.

2. The electrical bushing of claim 1 in which the epoxy resinous body is non-porous.

3. The electrical bushing of claim 2 in which the epoxy resin is an anhydride cured bisphenol resin filled with a graded particle size fused silica.

4. The electrical bushing of claim 2 in which a portion of the inner surface of the shell is covered with a gritty material, whereby the resinous body is interlocked within the shell.

* * * * *